US010710131B2

(12) United States Patent
Alken et al.

(10) Patent No.: US 10,710,131 B2
(45) Date of Patent: Jul. 14, 2020

(54) ROLL ARRANGEMENT

(71) Applicant: SMS GROUP GMBH, Düsseldorf (DE)

(72) Inventors: Johannes Alken, Siegen (DE); Ralf Seidel, Dillenburg (DE)

(73) Assignee: SMS GROUP GMBH, Düsseldorf (DE)

( * ) Notice: Subject to any disclaimer, the term of this patent is extended or adjusted under 35 U.S.C. 154(b) by 197 days.

(21) Appl. No.: 15/569,447

(22) PCT Filed: Apr. 21, 2016

(86) PCT No.: PCT/EP2016/058873
§ 371 (c)(1),
(2) Date: Oct. 26, 2017

(87) PCT Pub. No.: WO2016/188681
PCT Pub. Date: Dec. 1, 2016

(65) Prior Publication Data

US 2018/0297093 A1 Oct. 18, 2018

(30) Foreign Application Priority Data

May 26, 2015 (DE) ..... 10 2015 209 637

(51) Int. Cl.
*B21B 31/07* (2006.01)

(52) U.S. Cl.
CPC ..... *B21B 31/074* (2013.01); *B21B 31/078* (2013.01)

(58) Field of Classification Search
CPC ..... B21B 31/07; B21B 31/074; B21B 31/076; B21B 31/078
See application file for complete search history.

(56) References Cited

U.S. PATENT DOCUMENTS 3,453,031 A * 7/1969 Bjork ..... B21B 31/074 384/118
5,000,584 A 3/1991 Simmons
(Continued)

FOREIGN PATENT DOCUMENTS

CA 1186358 A 4/1985
DE 3117746 A1 12/1982
(Continued)

OTHER PUBLICATIONS

Garber EA et al: "Performance on the Liquid-Friction Bearings of Supporting Rollers in Cold-Rolling Mills". Steel in Translation, Allerton Press, New York, NY, US, vol. 35, No. 3, Jan, 1, 2005 (Jan. 1, 2005). pp. 55-60, XP001243468.

*Primary Examiner* — Debra M Sullivan
(74) *Attorney, Agent, or Firm* — Lucas & Mercanti, LLP; Klaus P. Stoffel

(57) ABSTRACT

A roll arrangement for rolling rolling material in a rolling system. The roll arrangement includes a roll that is rotatably mounted by its roll journal in a bearing bush of a chock. A ring gap for receiving a lubricant is formed between the bearing bush and the roll journal. The ring gap is sealed both on the ball side of the chock and on the side of the chock away from the balls, using sealing rings. In order to increase the load capacity or the rolling force of a roll arrangement while maintaining or reducing the construction size thereof and without the roll arrangement overheating, discharge channels are provided in a through-flow angular range of the bearing bush for discharging the lubricant out of the ring gap into an oil-receiving chamber.

11 Claims, 5 Drawing Sheets

(56) References Cited

U.S. PATENT DOCUMENTS

| | | | | |
|---|---|---|---|---|
| 5,678,931 | A * | 10/1997 | Woodrow | B21B 31/074 384/114 |
| 6,146,020 | A | 11/2000 | Innis, Jr. | |
| 6,585,419 | B2 | 7/2003 | Ono et al. | |
| 2002/0103062 | A1* | 8/2002 | Wojtkowski, Jr. | B21B 31/074 492/48 |
| 2007/0158916 | A1 | 7/2007 | Roeingh et al. | |
| 2010/0284639 | A1* | 11/2010 | Keller | B21B 31/07 384/428 |
| 2011/0274380 | A1* | 11/2011 | Wojtkowski, Jr. | B21B 31/074 384/322 |

FOREIGN PATENT DOCUMENTS

| | | | |
|---|---|---|---|
| DE | 69007079 | T2 | 6/1994 |
| DE | 19831301 | A1 | 1/2000 |
| DE | 10156344 | A1 | 5/2002 |
| EP | 1031389 | B1 | 8/2000 |
| EP | 1699575 | B1 | 9/2006 |
| SU | 1442288 | A1 | 12/1988 |

* cited by examiner

ROLL ARRANGEMENT

The present application is a 371 of International application PCT/EP2016/058873, filed Apr. 21, 2016, which claims priority of DE 10 2015 209 637.8, filed May 26, 2015, the priority of these applications is hereby claimed and these applications are incorporated herein by reference.

BACKGROUND OF THE INVENTION

The invention relates to a roll arrangement for rolling rolling material in a rolling system.

PRIOR ART

In the case of oil film bearings, as are customarily used for the mounting of supporting rolls in rolling stands for metallic rolling material, a roll journal rotates in a stationary bearing bushing, wherein the bearing bushing is arranged in a chock. The difference in diameter between the roll journal and the bearing bushing is customarily within the range of 1% of the bearing diameter, i.e. approximately 1 mm of play in a bearing diameter of 1 m, for which reason a corresponding annular gap is formed between the roll journal and the bearing bushing. The annular gap is typically filled with lubricant, for example oil, and therefore an oil film forms in the annular gap.

If, during operation of the rolling stand, an external force, for example the rolling force, is applied to the bearing, first of all the rotating roll journal is displaced eccentrically with respect to the bearing bushing in the radial direction counter to the external direction of the force. The annular gap between the roll journal and the bearing bushing then has a minimum cross section on the one side and, precisely opposite thereto, a maximum cross section. The oil which is supplied to the annular gap via hydrodynamic pockets is transported on the rotating surface of the roll journal into the region of the narrowest cross section by means of the no-slip condition. Since the cross section of the gap becomes ever smaller as far as the narrowest point, the oil is squeezed out to the side of the bearing. At the same time, however, the pressure in the oil film also rises, as a result of which the bearing is capable of supporting a greater external force. The oil which is pressed out on both sides of a bearing is customarily referred to as bearing side flow.

Documents EP 1 031 389 B1, EP 1 699 575 B1 and DE 198 31 301 A1 describe sealing devices for rolls in rolling mills.

Document DE 3 117 746 A1 describes a hydrodynamic radial bearing.

In the technical documentation "OIL-FILM BEARINGS FOR ROLLING-MILLS", Copyright 1967, American Society of Lubrication Engineers (prepared by the Steel Industrie Council of the American Society of Lubrication Engineers), hydrostatic oil film bearings for rolls in a rolling mill are described.

The oil film between the roll journal and the bearing surface receiving the roll journal is also referred to below as a lubricating film. A disadvantage in the case of systems without side flow reduction is the high side flow of the lubricant, even if the latter is not required for cooling purposes. A large outlay on supply and a large periphery are required in order to provide sufficient lubricant. At low rotational speeds, additional hydrostatic support is necessary in order to absorb relatively large rolling forces; otherwise, the load-bearing capacity of the bearing is comparatively rather small. In addition, the specific overall size is high, depending on the rolling force required.

One of the disadvantages in the case of systems having a completely sealed annular gap without a discharge possibility for the lubricant is that the operating temperature of the lubricant and of the roll journal rises especially at higher rotational speeds and therefore complicated cooling systems are required in order to limit the temperature rise or to keep the latter constant. The temperature rise causes the viscosity of the lubricant to drop. Consequently, the lubricant pressure also drops, and the bearing capacity of the bearing is reduced. Nonreturn valves are generally integrated in the closed systems in order to prevent the cooling circuit from running dry.

SUMMARY OF THE INVENTION

It is the object of the invention to develop a known roll arrangement to the effect that the bearing capacity thereof or the rolling force can be increased while maintaining or with a reduction of its overall size without the roll arrangement overheating. In addition, the roll arrangement according to the invention is intended to be easy to install and retrofittable in existing systems.

This object is achieved by a roll arrangement in which the bearing bushing—as seen in the circumferential direction—is divided into a through-flow angular range and a shut-off angular range. In the through-flow angular range, the bearing bushing has at least one discharge channel for conducting the lubricant out of the annular gap into an oil receiving chamber. The through-flow angular range extends adjacent to the shut-off angular range over an angular range of 360° minus the shut-off angular range. The shut-off angular range $\alpha$, starting from $A+\gamma$ with $10°<\gamma<25°$, extends by a maximum of 270° counter to the direction of rotation of the roll, wherein A defines a supporting load point which is represented by the angular position A of the narrowest gap (hmin) between roll journal and chock in the event of a load, wherein A defines a supporting load point which is represented by the angular position A of the narrowest gap (hmin) between roll journal and chock in the event of a load.

The shutting-off of the side flow of the lubricant with the aid of the sealing rings causes the roll arrangement according to the invention to initially lead to an increase in pressure of the lubricant in the annular gap in the region of the supporting load point and therefore to an increase in the bearing capacity or an increase in the rolling force of the roll arrangement. At the same time, the thickness of the lubricating film is increased in the region of the supporting load point and therefore the operational reliability, for example in respect of edge loading and with respect to the starting behavior, is improved. In particular in the front rolling stands of a rolling system, in which only little heat arises in the bearing because of the relatively low rotational speed and therefore also only little cooling is necessary, the build up of pressure by the provision of the sealing rings can be realized in a simple and advantageous manner.

With the aid of appropriate computer models, based on long term experiences and tests, it is already possible during the planning of the roll arrangement to define the shut-off region for a bearing bushing and the pass-through region with the discharge channels for the lubricant in such a manner that a desired bearing capacity of the roll arrangement can be realized even at higher rotational speeds without the roll arrangement overheating. Structural changes to the chock and/or the roller are generally not required for this purpose. With an increasing size of the angle for the shut-off region, the through flow of lubricant out of the annular gap is reduced. The reduction or constricting of the side flow of the lubricant within the bearing advantageously leads to an increase in the load-bearing capacity of the roll arrangement.

This increase in the load-bearing capacity is advantageously achieved without there being any concern that the bearing will overheat. This is true because, in the through-flow angular range of the bearing bushing, which range is complementary to the shut-off angular range, of 360° minus shut-off angular range, the at least one discharge channel is dimensioned according to the invention in such a manner that it permits a sufficient lateral discharge of the lubricant which, in turn, ensures sufficient transport of heat away from the bearing.

The invention advantageously permits simple retrofitting in existing systems. For example, over the course of modernization measures to existing rolling systems, the rolling force and therefore the power capacity of the existing rolling system can be increased by up to 40% without increasing the construction space. Existing systems can be easily and cost-effectively refitted to meet increased rolling force requirements, for example because of processing different material grades or material thicknesses. A previous bearing bushing can easily be exchanged for a bearing bushing according to the invention. In addition, the barrel-side and barrel-remote sealing rings on existing roll arrangements can be retrofitted.

If an increased rolling force is not required, the roll arrangement in the case of new systems can be dimensioned to be overall smaller beforehand in order to ensure the same bearing capacity as previously. This especially saves on construction space, material costs and manufacturing time.

According to a first exemplary embodiment, a journal bushing is provided for pulling onto the roll journal. In the event of wear, the journal bushing can advantageously be easily and cost-effectively exchanged. The annular gap is then formed between the bearing bushing and the journal bushing.

According to a further exemplary embodiment, it is provided that, in the event of a load, the supporting load point A is arranged in an angular range of $\varphi=+/-25°$ with respect to the center axis Y of the roll, said center axis being perpendicular to the plane of the rolling material.

According to a further exemplary embodiment of the invention, in the through-flow angular range, the bearing bushing has at least one barrel-side discharge channel for the fluid-conducting connection of the annular gap to a barrel-side oil receiving chamber and at least one barrel-remote discharge channel for the fluid-conducting connection of the annular gap to a barrel-remote oil receiving chamber. The two discharge channels advantageously permit a radial and lateral discharge of oil from the annular gap of the bearing bushing. With the outflowing oil, more heat is removed from the annular gap than via a collecting return flow present in any case in the chock, and therefore overheating of the annular gap or in particular of the journal bushing and of the roll journal is reliably prevented even under an increased load capacity.

The in particular radial discharge channels are advantageously arranged distributed in the circumferential direction in the circumferential angular range of the journal bushing or extend in the circumferential direction. They can have, for example, a slot-shaped cross section which extends in the circumferential direction within the through-flow angular range, or a plurality of discharge channels can be provided which are arranged next to one another in the circumferential direction on the barrel side or on the barrel-remote side in the through-flow angular range of the bearing bushing.

In the through-flow angular range, the bearing bushing can have an oil pocket on its inner side facing the roll journal, and the at least one discharge channel is then preferably arranged in such a manner that it can remove the oil from the oil pocket into the oil receiving chamber.

The roll of the roll arrangement according to the invention can be a working roll, a supporting roll or an intermediate roll.

Further advantageous refinements of the invention are the subject matter of the dependent claims.

DETAILED DESCRIPTION OF THE INVENTION

The invention is described in detail below in the form of various exemplary embodiments with reference to the figures mentioned. In all of the figures, identical technical elements are denoted by the same reference sign.

Figure 1:
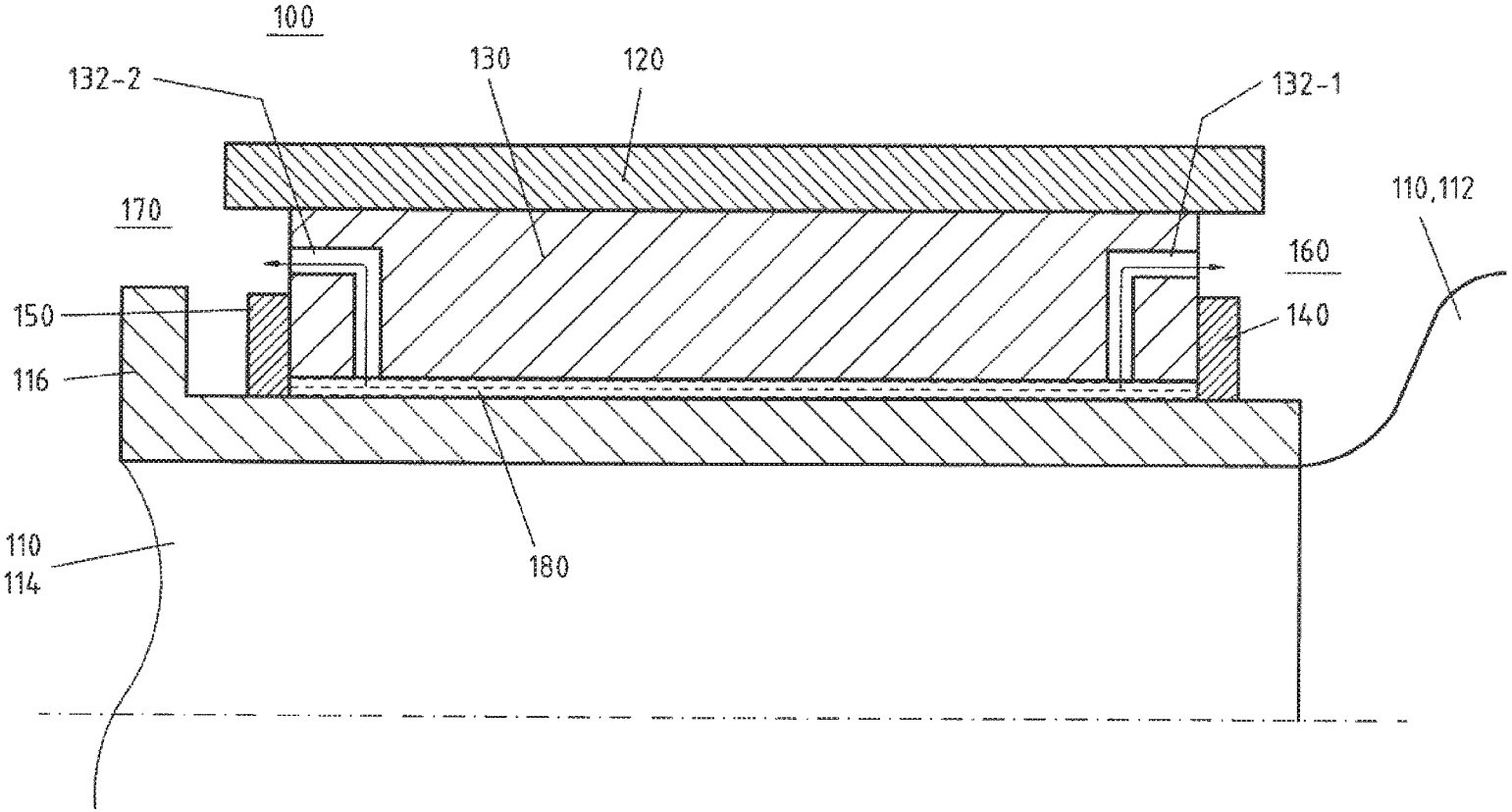
FIG. 1 shows a first exemplary embodiment of the roll arrangement according to the invention in a longitudinal section.

FIG. 1 shows a first exemplary embodiment of the roll arrangement 100 according to the invention. The roll arrangement 100 comprises a roll 110 with a roll barrel 112 and a roll journal 114. In a rolling stand, the roll is mounted rotatably in a chock 120, put more precisely in a bearing bushing 130 which is arranged in the chock for rotation therewith. The bearing bushing 130 has a receiving opening for receiving the roll journal 114, wherein the inside diameter of the receiving opening is designed to be larger than the outside diameter of the roll journal or of the journal bushing 116 placed on the latter in such a manner that an annular gap 180 for receiving a lubricant, typically oil, remains between the bearing bushing and the roll journal or the journal bushing 116; see FIG. 2.

A sealing ring 140 is arranged on the end side of the receiving opening on the roll barrel side for sealing the annular gap there in relation to a receiving chamber 160 on the roll barrel side. Analogously, a further sealing ring 150 is arranged on the end side of the receiving opening remote from the roll barrel for sealing the annular gap 180 there in relation to the oil receiving chamber 170 there which is remote from the roll barrel.

As shown in FIG. 1, the bearing bushing 130 has at least one discharge channel 132 for conducting the lubricant out of the annular gap 180 into one of the oil receiving chambers 160, 170. In the case of the first exemplary embodiment shown in FIG. 1, a barrel-side discharge channel 132-1 and a barrel-remote discharge channel 132-2 are provided for conducting oil out of the annular gap 180. For this purpose, the discharge channels 132-1, 132-2 are connected in a fluid-conducting manner to the annular gap and to the respective oil receiving chamber 160, 170. As shown in FIG.

1, the discharge channels extend, by way of example in portions, in the radial and axial direction.

Figure 2:
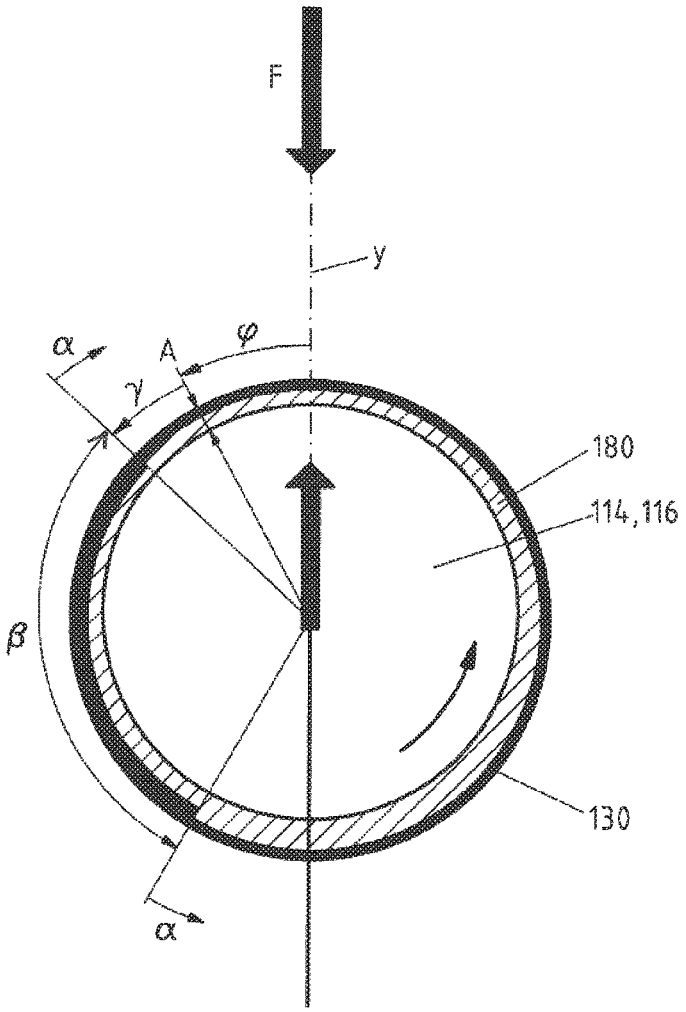
FIG. 2 shows the roll arrangement according to the invention in a cross section.

FIG. 2 shows a cross section through the roll arrangement according to the invention under the load of the rolling force F which here acts by way of example in the direction of the center plane Y. Owing to the interaction of action and reaction of the rolling force F, the roll journal 114 is displaced, optionally together with the journal bushing 116, eccentrically within the bearing bushing 130, and therefore an asymmetrical annular gap 180 or an asymmetrical oil film arises. At the position of the supporting load point A, the annular gap 180 assumes the minimum height or thickness $h_{min}$.

According to the invention, the bearing bushing 130—as seen in the circumferential direction—is divided into a through-flow angular range β and a shut-off angular range α which is understood as meaning the difference between 360° and the through-flow angular range β. The shut-off angular range α extends, starting from A+γ with $-10° < \gamma < +35°$ by a maximum of 270° counter to the rotational direction of the roll. Accordingly, the through-flow range is defined as the complementary angular range to the shut-off angular range, i.e. 360° minus the shut-off angular range α. In the event of a load, the supporting load point A lies in an angular range of φ=+/−25° with respect to the center axis Y of the roll, said center axis being perpendicular to the plane of the rolling material.

Figure 3:
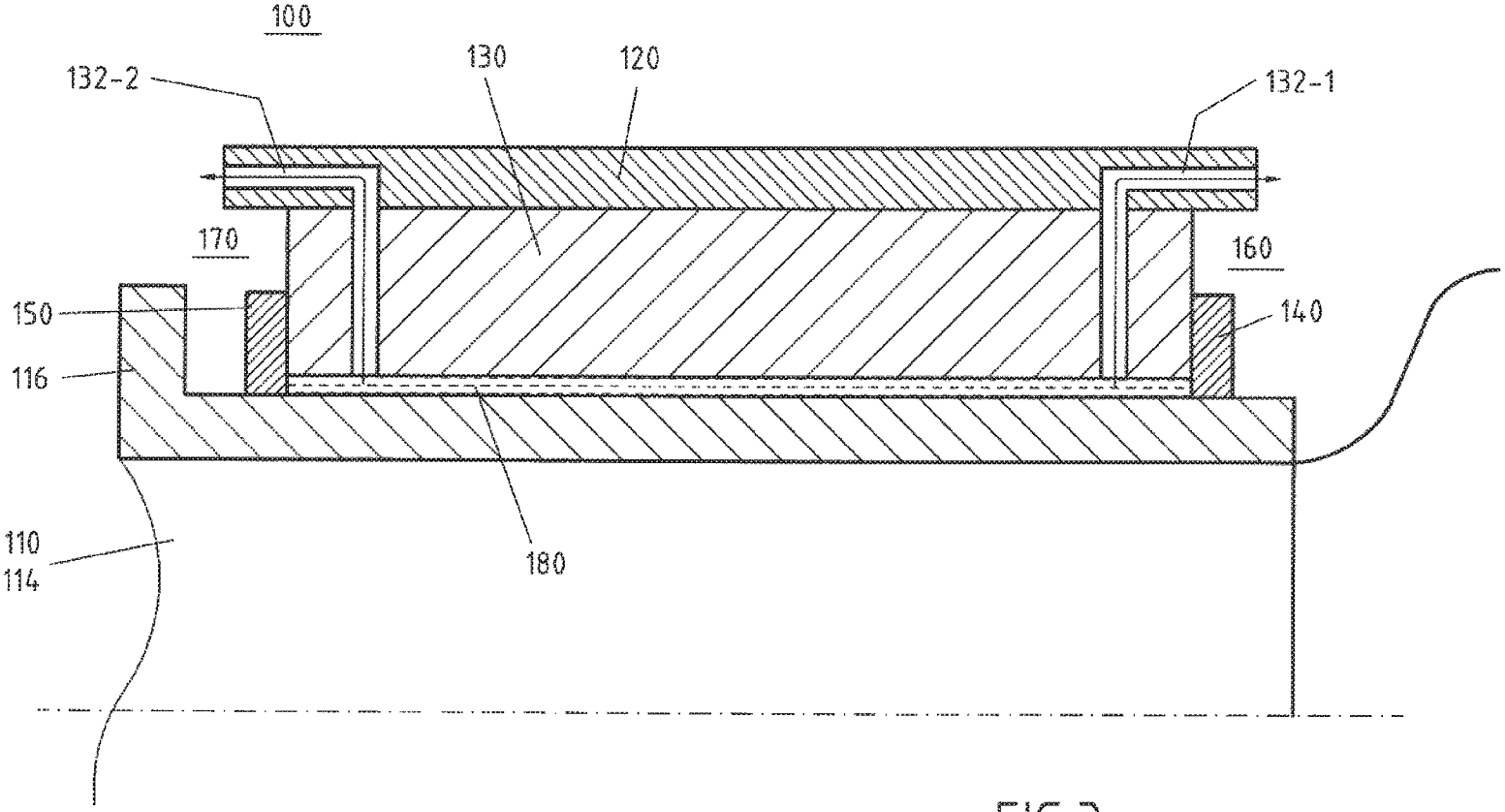
FIG. 3 shows a second exemplary embodiment of the roll arrangement according to the invention.

FIG. 3 shows a second exemplary embodiment for the roll arrangement, put more precisely for a possible guide of the discharge channels 132. Specifically, the second exemplary embodiment makes provision for the barrel-side and the barrel-remote discharge channels 132-1, 132-2 to be guided not only—starting from the annular gap 180—in the radial direction through the bearing bushing 130 but also away from the latter through the chock 120 in order to emerge, preferably in the axial direction, on the end sides thereof into the respective oil receiving chambers 160, 170.

Figure 4:
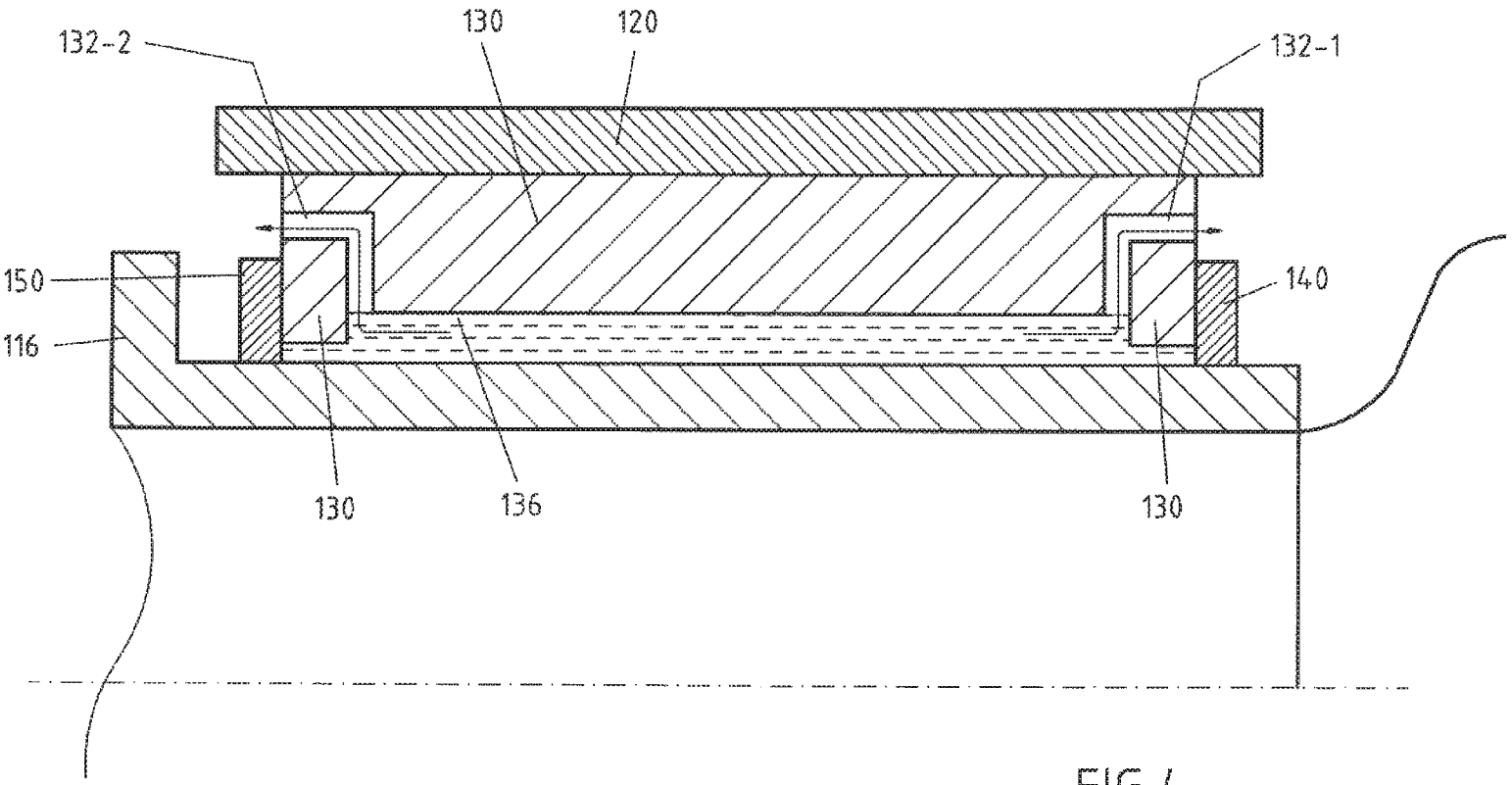
FIG. 4 shows a third exemplary embodiment of the roll arrangement according to the invention.

FIG. 4 shows a third exemplary embodiment for the arrangement according to the invention, in particular for a possible guiding of the discharge channels. A particular characteristic here can be seen in that the bearing bushing 130 has an oil collecting pocket 136 on its inner side facing the roll journal 114 and that the at least one discharge channel 132-1, 132-2 is in fluid-conducting connection to the oil pocket 136. The oil pocket is a local recess on the inner side of the bearing bushing and in this respect the oil pocket acts as a local volumetric increase of the annular gap; in the region of the oil collecting pocket, the thickness of the annular gap 180 and therefore the thickness of the oil film located therein are increased.

According to the invention, the discharge channels 132, 132-1, 132-2 are always formed only in the through-flow angular range β, but never in the shut-off angular range α.

Figure 5:
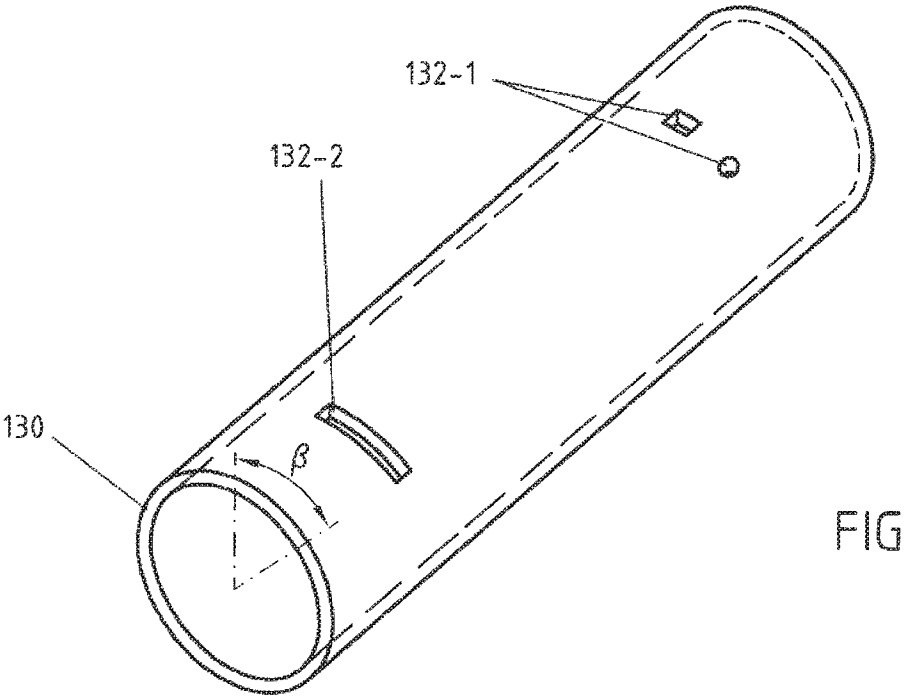
FIG. 5 shows the bearing bushing according to the invention with various variants for the discharge channels.

FIG. 5 shows possible arrangements and cross-sectional shapes for the discharge channels. The cross-sectional shapes shown there, slit-shaped, round or rectangular, should be understood as merely being by way of example; of course, the discharge channels can have any desired cross-sectional shape. It is advantageous if the discharge channels extend in the circumferential direction of the bearing bushing, whether it be, for example, slot-shaped, shown on the left in FIG. 5, or in the form of a plurality of singular discharge channels arranged distributed in the circumferential direction, as shown on the right in FIG. 5.

LIST OF REFERENCE SIGNS

100 Roll arrangement
110 Roll
112 Roll barrel
114 Roll journal
116 Journal bushing
120 Chock
130 Bearing bushing
132 Drain channel
132-1 Barrel-side discharge channel
132-2 Barrel-remote discharge channel
136 Oil pocket
140 Sealing ring on the roll barrel side
150 Sealing ring remote from the roll barrel
160 Barrel-side oil receiving chamber
170 Barrel-remote oil receiving chamber
180 Annular gap
α Shut-off angular range
β Through-flow angular range
φ Angular range for supporting load point
A Supporting load point
Y Angle

The invention claimed is:

1. A roll arrangement for rolling rolling material in a rolling system, comprising:

a roll with a roll barrel and a roll journal;

a chock with a bearing bushing arranged for rotation with the chock and having a receiving opening for receiving the roll journal, wherein the receiving opening has an inside diameter larger than an outside diameter of the roll journal so that an annular gap for receiving a lubricant remains between the bearing bushing and the roll journal;

a sealing ring which is arranged against the bearing bushing on an end of the receiving opening on a roll barrel side for sealing the annular gap; at least one oil receiving chamber; and a sealing ring arranged against the bearing bushing on an end side of the receiving opening remote from the roll barrel for sealing the annular gap; wherein the bearing bushing, as seen in a circumferential direction, is divided into a through-flow angular region and a shut-off angular region; wherein, in the through-flow angular region, the bearing bushing has at least one discharge channel for conducting the lubricant out of the annular gap into the oil receiving chamber;

wherein the through-flow angular region extends adjacent to the shut-off angular region over an angular range of 360° minus the shut-off angular region;

wherein the bearing bushing is configured so that the shut-off angular region, starting from A+γ, wherein $-10° < \gamma < 35°$, extends by a maximum of 270° counter to a direction of rotation of the roll, wherein A is a supporting load point represented by the angular position of a narrowest gap between the roll journal and the chock in event of a load.

2. The roll arrangement according to claim 1, further comprising a journal bushing arranged on the roll journal for rotation therewith;

wherein the receiving opening of the bearing bushing is configured to receive the roll journal together with the journal bushing; and wherein the annular gap for the lubricant is formed between the bearing bushing and the journal bushing.

3. The roll arrangement according to claim 1, wherein, in the event of a load, the supporting load point is arranged in an angular range of φ=+/−25° with respect to a center axis Y of the roll, said center axis being perpendicular to a plane of the rolling material.

4. The roll arrangement according to claim 1, wherein the at least one oil receiving chamber includes a barrel-side oil receiving chamber between the chock and the roll barrel and a barrel-remote oil receiving chamber at a barrel-remote end of the roll journal.

5. The roll arrangement according to claim 4, wherein, in the through-flow angular region, the bearing bushing has at least one barrel-side discharge channel for a fluid-conducting connection of the annular gap to the barrel-side oil receiving chamber and at least one barrel-remote discharge channel for fluid-conducting connection of the annular gap to the barrel-remote oil receiving chamber.

6. The roll arrangement according to claim 4, wherein the at least one discharge channel runs from the bearing bushing through the chock and opens from the chock into one of the at least one oil receiving chambers.

7. The roll arrangement according to claim 6, wherein the at least one discharge channel includes a plurality of discharge channels arranged next to one another in the circumferential direction within the through-flow angular range.

8. The roll arrangement according to claim 1, wherein the at least one discharge channel has a slot-shaped cross section that extends in the circumferential direction within the through-flow angular range.

9. The roll arrangement according to claim 1, wherein the at least one discharge channel includes a plurality of discharge channels arranged next to one another in the circumferential direction within the through-flow angular region.

10. The roll arrangement according to claim 1, wherein, in the through-flow angular region, the bearing bushing has a collecting oil pocket on an inner side facing the roll journal; and wherein the at least one discharge channel is in fluid-conducting connection to the collecting oil pocket.

11. The roll arrangement according to claim 1, wherein the roll is a working roll, a supporting roll or an intermediate roll.

* * * * *